US005551876A

United States Patent [19]

Koresawa et al.

[11] Patent Number: 5,551,876

[45] Date of Patent: Sep. 3, 1996

[54] TARGET PRACTICE APPARATUS

[75] Inventors: Sumio Koresawa; Masanori Yamazaki, both of Kure; Hidetoshi Imaide, Tokyo, all of Japan

[73] Assignee: Babcock–Hitachi Kabushiki Kaisha, Tokyo, Japan

[21] Appl. No.: 393,397

[22] Filed: Feb. 23, 1995

[30] Foreign Application Priority Data

Feb. 25, 1994 [JP] Japan ..... 6-028195

[51] Int. Cl.[6] ..... F41G 3/26

[52] U.S. Cl. ..... 434/16; 434/11; 434/17; 434/19; 434/20

[58] Field of Search ..... 434/11, 14–17, 434/19–21, 23, 27

[56] References Cited

U.S. PATENT DOCUMENTS 4,264,309 4/1981 Brooksby ..... 434/20
4,552,533 11/1985 Walmsley ..... 434/12

FOREIGN PATENT DOCUMENTS 56-119499 9/1981 Japan .
62-17193 4/1987 Japan .
1-193600 8/1989 Japan .
2-61499 3/1990 Japan .

*Primary Examiner*—Richard J. Apley
*Assistant Examiner*—Glenn E. Richman
*Attorney, Agent, or Firm*—Fay, Sharpe, Beall, Fagan, Minnich & McKee

[57] ABSTRACT

A target practice apparatus which allows a trainee to shoot at a target on a moving image with live bullets. The target practice apparatus includes a screen on which a training image is projected, three or more acoustic sensors for detecting an impact sound, impact coordinate measuring section for computing the coordinates of an impact position on the screen based on detection signals from the acoustic sensors, a projector, a playback unit for supplying the projector with an image signal, a recording medium which stores a hit image and a miss image as well as the training image, a memory unit in which a hit range and a miss range are previously stored for each frame of the training image, and a data processing and controlling section which compares the detected coordinates of the impact position with data of the hit range and the miss range stored in the memory unit to perform a hit/miss judgment, selects the hit image or the miss image based on the results of the judgment, and reproduces the selected image. The trainee can improves his ability to make a proper circumstantial judgment and effectively gains experience in shooting with live bullet.

10 Claims, 10 Drawing Sheets

| ADDRESS | 7 6 5 4 3 2 1 0 |
|---|---|
| 0 1 | FIRST RANGE ID CODE |
| 2 3 | IMAGE CODE |
| 4 5 | START FRAME NO. (m011) OF IMAGE FOR OUTSIDE OF SHOOTING CHANCE OF 1ST TARGET PRACTICE AND FOR MISS |
| 6 7 | START FRAME NO. (m012) OF IMAGE FOR SHOOTING CHANCE OF1ST TARGET PRACTICE |
| 8 9 | END FRAME NO. (m013) OF IMAGE FOR SHOOTING CHANCE OF 1ST TARGET PRACTICE |
| 10 11 | END FRAME NO. (m014) OF IMAGE FOR OUTSIDE OF SHOOTING CHANCE OF 1ST TARGET PRACTICE AND FOR MISS |
| 12 13 | START FRAME NO. (mO15) OF IMAGE FOR HIT IN 1ST TARGET PRACTICE |
| 14 15 | END FRAME NO. (m016) OF IMAGE FOR HIT IN 1ST TARGET PRACTICE |
| 16 17 | START FRAME NO. (m021) OF IMAGE FOR OUTSIDE OF SHOOTING CHANCE OF 2ND TARGET PRACTICE AND FOR MISS |
| 18 19 | START FRAME NO. (m022) OF IMAGE FOR SHOOTING CHANCE OF 2ND TARGET PRACTICE |
| 20 21 | END FRAME NO. (m023) OF IMAGE FOR SHOOTING CHANCE OF 2ND TARGET PRACTICE |
| 22 23 | END FRAME NO. (m024) OF IMAGE FOR OUTSIDE OF SHOOTING CHANCE OF 2ND TARGET PRACTICE AND FOR MISS |
| 24 25 | START FRAME NO. (m026) OF IMAGE FOR HIT IN 2ND TARGET PRACTICE |
| 26 27 | END FRAME NO. (m026) OF IMAGE FOR HIT IN 2ND TARGET PRACTICE |
| ⋮ | ⋮ |
| 172 173 | START FRAME NO. (m151) OF IMAGE FOR OUTSIDE OF SHOOTING CHANCE OF 15TH TARGET PRACTICE AND FOR MISS |
| 174 175 | START FRAME NO. (m152) OF IMAGE FOR SHOOTING CHANCE OF 15TH TARGET PRACTICE |
| 176 177 | END FRAME NO. (m153) OF IMAGE FOR SHOOTING CHANCE OF 15TH TARGET PRACTICE |
| 178 179 | END FRAME NO. (m154) OF IMAGE FOR OUTSIDE OF SHOOTING CHANCE OF 15TH TARGET PRACTICE AND FOR MISS |
| 180 181 | START FRAME NO. (m155) OF IMAGE FOR HIT IN 15TH TARGET PRACTICE |
| 182 183 | END FRAME NO. (m156) OF IMAGE FOR HIT IN 15TH TARGET PRACTICE |

FIG. 6

TARGET PRACTICE APPARATUS

BACKGROUND OF THE INVENTION

1. Field of the Invention

The present invention relates a target practice apparatus, and more particularly to a target practice apparatus utilizing a target in the form of a projected image which allows shooting with live bullets and which improves the ability of a trainee to make a proper circumstantial judgment.

2. Related Art

Target practice is categorized into basic target practice in which a trainee improves his hitting accuracy when using live bullets, and advanced target practice in which the trainee shoots while judging a suitable timing and situation for firing.

In target practice, a trainee generally shoots at a stationary, moving or bobbing target, and the trainee or a judge visually checks the impact position on the target to evaluate the hitting accuracy and the ability of the trainee to make a proper circumstantial judgment.

To automatically and safely check such an impact position, various target practice apparatuses have been proposed. For example, in the target practice apparatus disclosed in Japanese Patent Application Laid-Open (kokai) No. 53-121657, a sound wave due to firing of a live bullet is detected by a plurality of acoustic sensors to obtain an impact position on the target based on differences among points of time when the sound wave is detected by the sensors. In the target practice apparatus disclosed in Japanese Patent Application Laid-Open (kokai) No. 5-196395, images of a target are captured by a video camera, and images before and after hitting of a bullet are processed to obtain the impact position based on the bullet mark.

Also, Japanese Patent Application Laid-Open (kokai) 56-119499 discloses a target practice apparatus which provides a moving target. This target practice apparatus utilizes a projected target device in which an image projected on a screen is used as a target. In the target device, a plurality of spaced strips of conductive rubber for an X-axis and a plurality of spaced strips of conductive rubber for a Y-axis are superposed onto each other in a grid-like configuration, and a screen on which an image is projected is attached to the surface thereof. When a bullet hits the screen, the conductive rubber for the X-axis contacts the conductive rubber for the Y-axis due to impact of the bullet so that an electrical connection is established between them. The position of the electrical connection represents the coordinates of the impact position. The impact position is then displayed on the screen using a spot light.

Other examples of target practice apparatuses in which bullets are actually shot at a projected image are disclosed in Japanese Patent Application Laid-Open (kokai) No. 2-61499 and Japanese Patent Application Laid-Open (kokai) No. 1-193600. In the apparatus disclosed in the former document, transparent conductive film is used instead of conductive rubber. In the apparatus disclosed in the latter document, a transparent target is used to allow an image to be projected from the rear side of the target, and transparent pressure sensitive resistors and photo diodes are arranged along a designated pattern. In this apparatus, an impact position is displayed by selectively turning on the photo diodes. However, these apparatus uses dummy bullets, and a projected target which responds to the impact of the dummy bullets.

In the advanced target practice for improving the ability to make a proper circumstantial judgment, it is preferred to use a target practice apparatus in which a projected target is used.

However, the apparatus disclosed in Japanese Patent Application Laid-Open (kokai) 56-119499 has the following disadvantages. First, a position detection mechanism which is formed by conductive rubber, conductive film, or pressure sensitive resistors may be destroyed when live bullets are used. Therefore, instead of live bullets, dummy bullets are used in the apparatuses of Japanese Patent Application Laid-Open (kokai) Nos. 1-193600 and 2-61499.

Second, since the projection screen is formed by superposing conductive rubber sheets or conductive films in a grid-like configuration, an enormous number of rubber sheets or films is needed. For example, in the case where an impact position must be detected on a screen measuring 2,400 mm×1,800 mm with an accuracy of 5 mm, 172,800 (480×360) conductive rubber sheets or conductive films must be bonded to the screen. This bonding work is troublesome, and the target must be replaced with a new one due to damage caused by live bullets. Therefore, this target incurs high operational costs.

Third, in the projection screen, an impact position on a screen which is detected by an impact position detector is displayed only by a spot light or a photo diode which is not related to various portions of a projected image. Therefore, it is impossible to vary the scoring depending on which parts of a human image are struck, such as the hands, legs, or head of the image.

SUMMARY OF THE INVENTION

An object of the present invention is to provide an improved target practice apparatus which uses a projected target to prevent a position detecting mechanism from being destroyed even if shooting is performed using live bullets.

Another object of the present invention is to provide an improved target practice apparatus in which a score for a hit can be varied depending on the location of an impact on the image.

Briefly, a target practice apparatus according to the present invention includes a screen on which an image for training (hereinafter referred to as a "training image") is projected, three or more acoustic sensors for detecting a sound generated when a bullet passes through the screen, an impact coordinate measuring section for computing the coordinates of an impact position on the screen based on differences among points of time when the acoustic sensors detect the sound, a projector for projecting the training image on the screen, a playback unit for supplying the projector with an image signal and including a recording medium in which an image representing a hit (hereinafter referred to as a "hit image") and an image representing a miss (hereinafter referred to as a "miss image") are recorded as well as the training image, a memory unit in which a hit range and a miss range are previously stored for each frame of the training image, and a data processing and controlling section. The data processing and controlling section controls the playback unit in a frame-by-frame fashion, compares the coordinates of the impact position fed from by the impact coordinate measuring section with data of the hit range and the miss range stored in the memory unit to judge whether a target is hit or missed, selects the hit image or the miss image, and reproduces the selected image. The target practice apparatus according to the present invention further includes a superimpose compositing unit for displaying a mark representing an impact position on the screen by superimposing the mark on the training image, and an output device for outputting a list of scores representing the results of the training which are determined based on the results of the judgment.

In the target practice apparatus according to the present invention, it is preferred to integrate the screen with the acoustic sensors to form a target member. That is, the target member is provided with a frame for holding the edge of the screen, and a group of at least three acoustic sensors is provided in one side of the frame.

In the target practice apparatus according to the present invention, it is preferred that the group of acoustic sensors be provided in each of two adjacent sides of the frame which are perpendicularly intersecting each other.

Also, it is preferred that the screen of the target practice apparatus be made of rubber and that the surface of the screen be white or silver-white.

The data processing and controlling section preferably includes time judging means for judging whether it is currently a time in which shooting is allowed or is a time in which shooting is prohibited, and hit judging means for judging whether or not a bullet hits an area within the hit range during the time that shooting is allowed.

Moreover, the target practice apparatus according to the present invention preferably includes a computer which generates a computer graphic image. In this case, the computer inputs a hit signal or a miss signal which is output from the data processing and controlling section so as to superimpose an image corresponding to the input signal on the computer graphic image. An image signal representing the superimposed computer graphic image is then output to the playback unit, which reproduces a graphic image from the image signal output from the computer. The projector projects the image, which has been reproduced by the playback unit, on the screen using a liquid crystal display projector.

In the shooting apparatus according to the present invention, shooting at an image of a moving target can be performed with live bullets. Accordingly, a trainee can improve his ability to make a proper circumstantial judgment and effectively gain experience in shooting with live bullets.

BRIEF DESCRIPTION OF THE ACCOMPANYING DRAWINGS

Various other objects, features and many of the attendant advantages of the present invention will be readily appreciated as the same becomes better understood with reference to the following detailed description of the preferred embodiments when considered in connection with the accompanying drawings, in which:

FIG. 1 is used;

FIG. 6 is an explanatory chart showing the start frame number and the like of each image of the training image;

DESCRIPTION OF PREFERRED EMBODIMENTS

Embodiments of the present invention will now be described with reference to the accompanying drawings.

Figure 1:
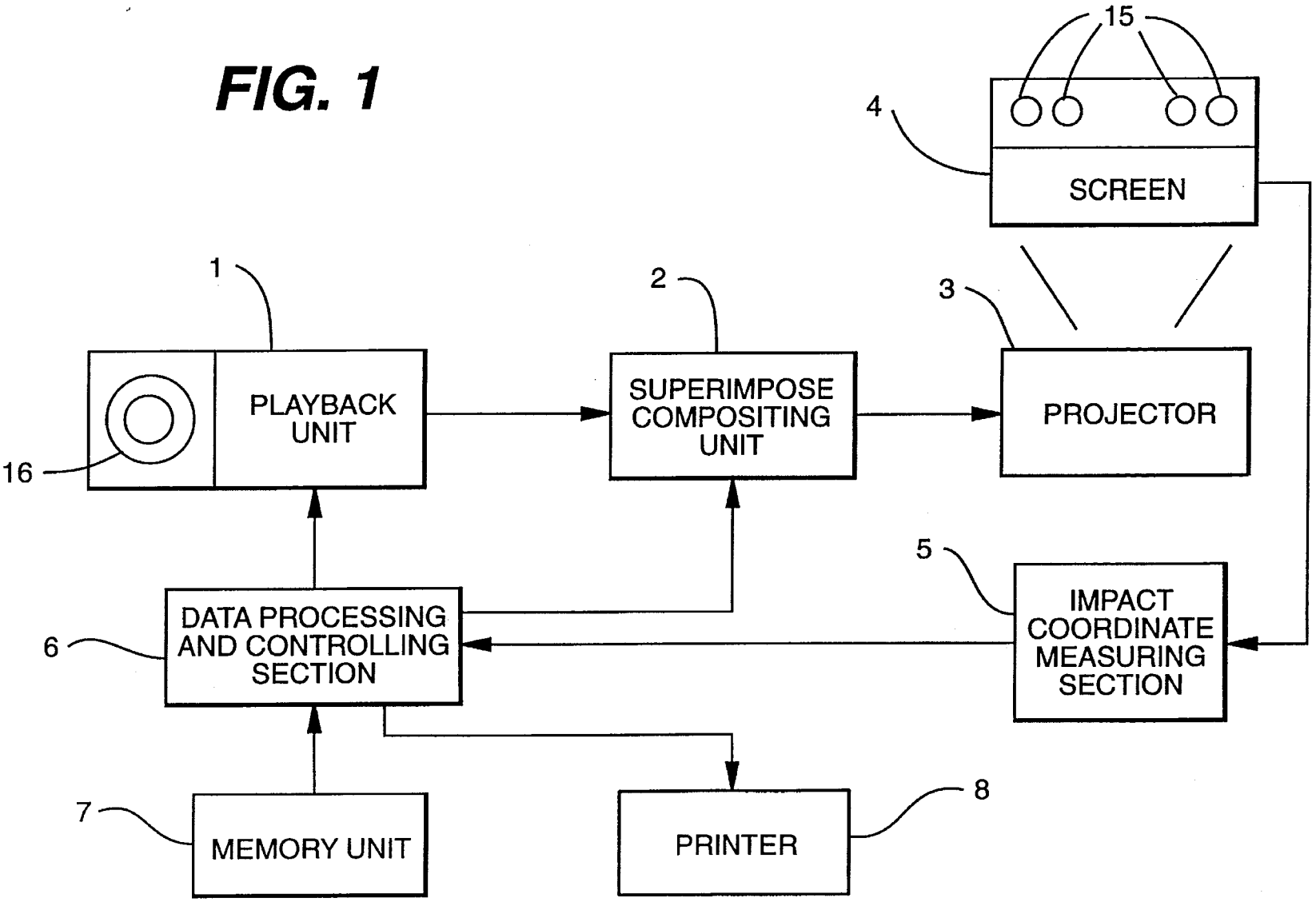
FIG. 1 is a block diagram showing a target practice apparatus according to a first embodiment of the present invention.

FIG. 1 is a block diagram showing a target practice apparatus according to a first embodiment of the present invention. The target practice apparatus includes a screen 4 on which a training image is projected, three or more acoustic sensors 15 for detecting a sound generated when a bullet passes through the screen 4, impact coordinate measuring section 5 for computing the coordinates of an impact position on the screen 4 based on differences among points of time when the respective acoustic sensors 15 detect the sound, a projector 3 for projecting the training image on the screen 4, a playback unit 1 for supplying the projector 3 with an image signal and including a recording medium 16 in which an image representing a hit (hit image) and an image representing a miss (miss image) are recorded, as well as the training image, a memory unit 7 in which a hit range and a miss range are previously stored for each frame of the training image, and a data processing and controlling section 6. The data processing and controlling section 6 controls the playback unit 1 in a frame-by-frame fashion, compares the coordinates of the impact position fed from the impact coordinate measuring section 5 with data of the hit range and the miss range stored in the memory unit 7 to perform a hit/miss judgment, selects the hit image or the miss image based on the results of the judgment, and reproduces the selected image. The target practice apparatus further includes a superimpose compositing unit 2 for displaying a mark representing an impact position on the screen by superimposing the mark on the training image, and a printer 8 serving as an output device for outputting a list of scores representing the results of the training.

The superimpose compositing unit 2 superimposes a hit signal or a miss signal which is output from the playback unit 1 on a training image which is also output from the playback unit 1, and outputs the composited signal to the projector 3. The superimpose compositing unit 2 superimposes the hit or miss signal on the training image in accordance with a control signal output from the data processing and controlling section 6.

Figure 2:
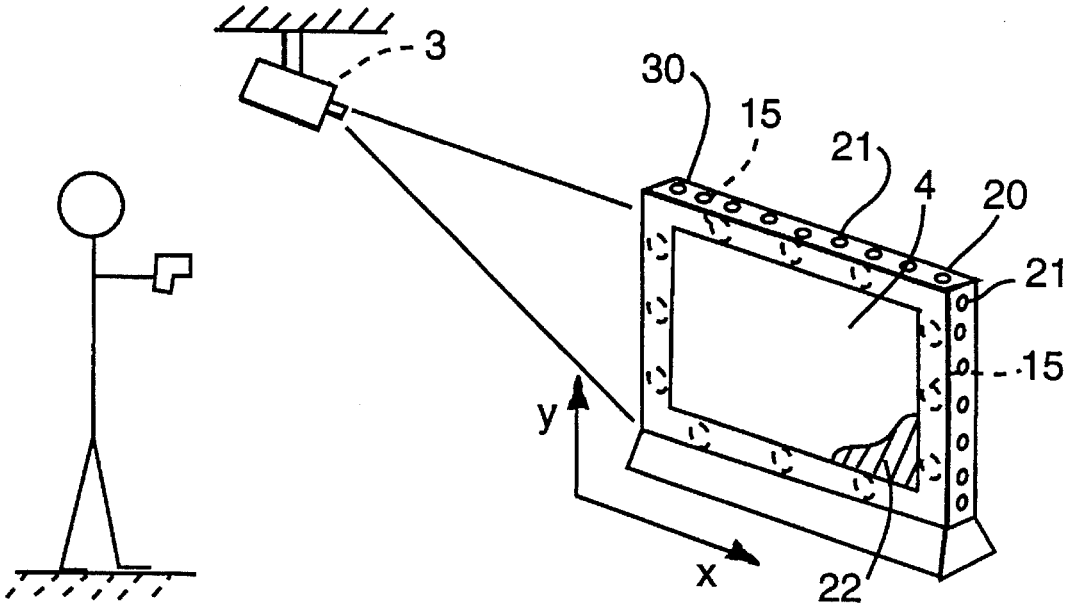
FIG. 2 is a perspective view showing a state in which the target practice apparatus shown

As shown in FIG. 1, a target section of the target practice apparatus according to the present embodiment has a structure such that the acoustic sensors 15 are arranged at the periphery of the screen 4. FIG. 2 is a perspective outside view showing a state in which the target practice apparatus according to the present embodiment is used. As shown in FIG. 2, the screen 4 and the acoustic sensors 15 are integrated to form a target member 30. In detail, the target member 30 has a frame 20 which holds the peripheral edge of the screen 4. A group of three or more acoustic sensors 15 is provided in each side of the frame 20. Although the group of acoustic sensors 15 is provided in each side of the frame 20 shown in FIG. 2, the group of acoustic sensors 15 may be provided only in a single side of the frame 20. In the present embodiment, a large size screen measuring 2.4 m×1.5 m is used. However, the impact of a bullet can be accurately detected, because the group of acoustic sensors is provided in each side.

The screen 4 is made of rubber, and the surface of the screen 4 is white or silver-white. In the present embodiment, a rubber having a hardness of 37±31 RHD and a stretching ratio of 700%.

The detail structure of the screen 4 will be described below. Since live bullets are shot against the screen 4, as shown in FIG. 2, the screen 4 is made of a rubber which is soft and has a large stretching ratio to reduce damage caused by bullets as much as possible. To improve the visibility of a training image projected by the projector 3, the screen 4 is formed such that its surface is delustered white or sliver-white. Further, a white or silver-white pigment is contained in the rubber itself. This minimizes a decrease in visibility due to damage of the rubber caused by the bullets, and eliminates the necessity of painting to repair the screen 4. A film 22 made of cloth or a polymer resin may be adhered to the back surface of the target member 30. The screen 4 and the film 22 cooperate to provide the capability of isolating outside sounds, thereby improving the detection accuracy of the acoustic sensors 15. Further, many through holes 21 communicating with the inner side of the frame 20 are formed in the frame 20 to allow air to circulate between the inside and outside of the target member 30. This structure maintains the internal temperature of the screen 4 and the target member 30 constant, thereby further increasing the detection accuracy of the acoustic sensors 15.

Figure 3:
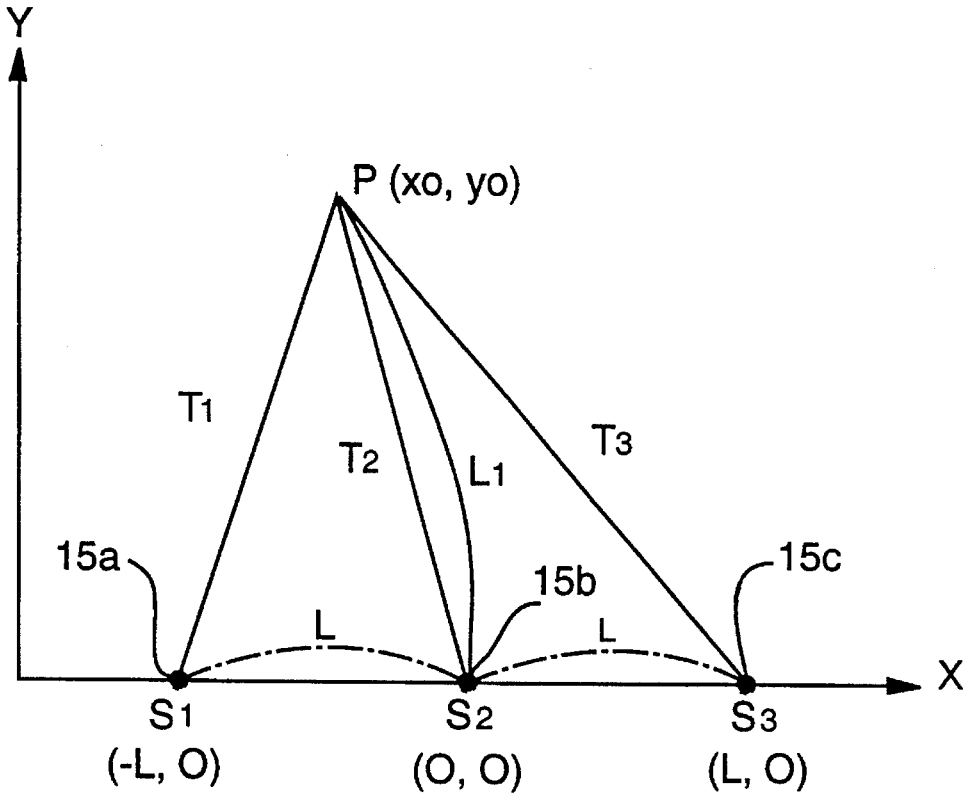
FIG. 3 is an explanatory chart showing a method of computing the coordinates of an impact position on the screen.

FIG. 3 is an explanatory chart showing a method of computing the coordinates of an impact position on the screen 4. In FIG. 3, points $S_1$, $S_2$, $S_3$ respectively show the positions where the acoustic sensors 15 are attached, i.e., the positions of the three acoustic sensors 15 provided at one peripheral side of the screen 4. In this embodiment, the sensors 15 are lined in parallel with the x-axis.

In FIG. 3, the difference between the time when the sensor 15*a* detects a sound and the time when the sensor 15*b* detects the sound is $T_1$, the difference between the time when the sensor 15*c* detects the sound and the time when the sensor 15*b* detects the sound is $T_2$, the distance between the sensors 15*a* and 15*b* and the distance between the sensors 15*b* and 15*c* are both L, and the coordinates of the impact position are P(x, y), the coordinates of the sensors 15*a*, 15*b* and 15*c* are $S_1(-L, O)$, $S_2(O, O)$ and $S_3(L, O)$, respectively. In this case, the x-axis coordinate $x_O$ and the Y-axis coordinate $y_O$ of the impact position is represented by the following mathematical expressions (1) and (2):

$$x_O=\{(T_1-T_2)(C^2T_1T_2, L^2)\}/\{2L(T_1+T_2)\} \quad (1)$$

$$y_O=(L_1^2-x_O^2) \quad (2)$$

wherein C is a sound velocity, and $L_1$ is the distance between P and $S_2$ which is represented by the following expression:

$$L_1=\{2L^2-C^2(T_1^2+T_2^2)\}/\{2C(T_1+T_2)\}.$$

Since the sensors are lined in the X-axis direction, the accuracy in detecting the Y-axis coordinate $y_O$ of the impact position is lower than that for the X-axis coordinate $x_O$. This was confirmed by experiments, which also revealed that the errors in detecting the Y-axis coordinate $y_O$ are more than double the errors in detecting the X-axis coordinate $x_O$. Accordingly, only the X-axis coordinate $x_O$ is used. The Y-axis coordinate $y_O$ is obtained by using three or more sensors 15 which are provided on the right or left-hand side of the screen 4 and which are linearly lined in the Y-axis direction, as shown in FIG. 2. The Y-axis coordinate $y_O$ can be accurately calculated in the same way as in the case of calculating the x-axis coordinate $x_O$.

After a bullet hits the screen 4, the target practice apparatus goes into its pause state, in which an impact mark is composited with the stationary training image, and the composited training image is displayed.

Figure 4:
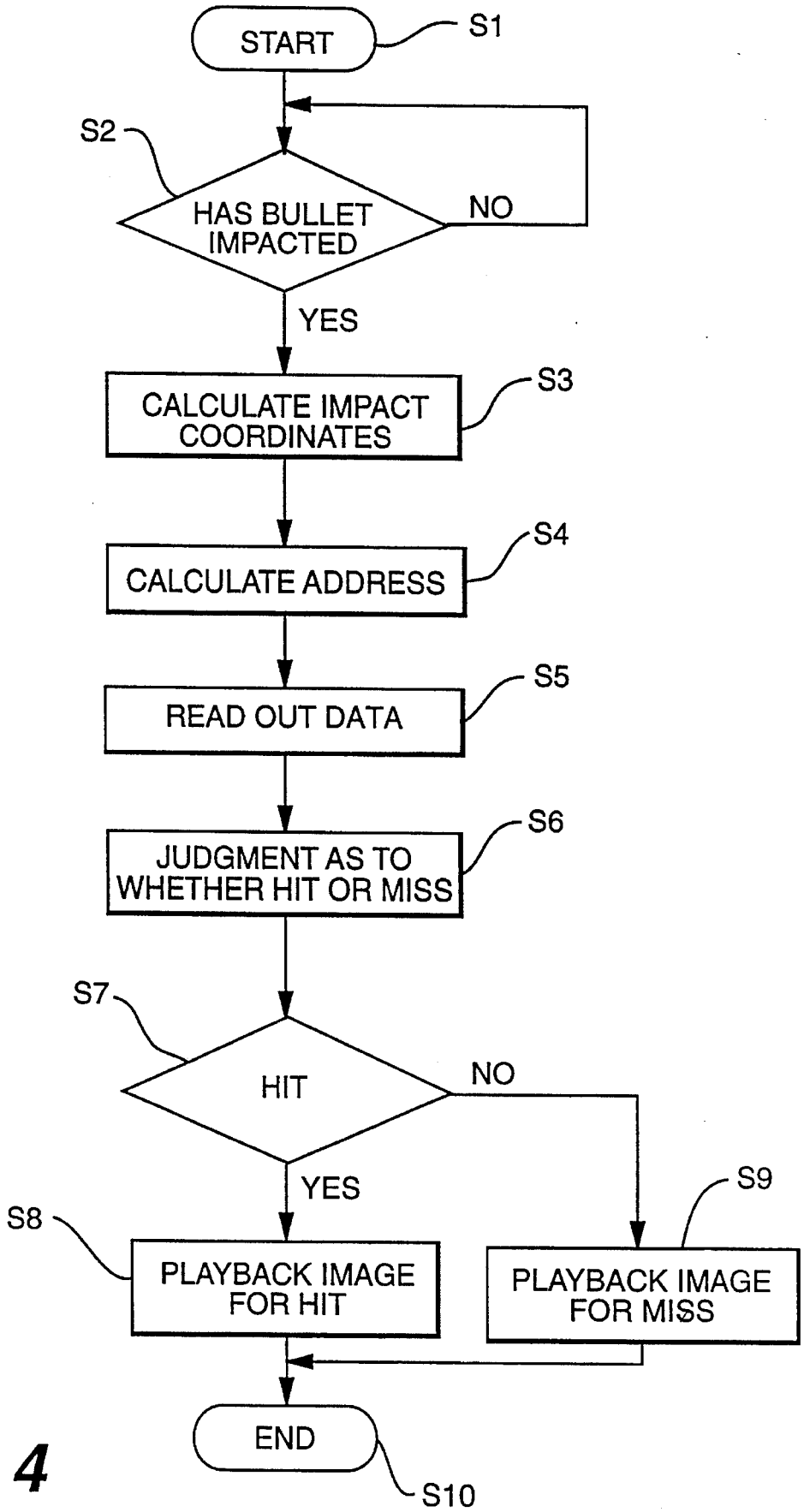
FIG. 4 is a flowchart showing a method of performing a hit/miss judgment used in the first embodiment.

Next, other operations of the data processing and controlling section 6 will be described. The data processing and controlling section 6 judges whether or not a bullet reached the screen 4 and hit a bad fellow in an image which was projected on the screen 4 at that time. FIG. 4 is a flowchart showing a method of performing a hit/miss judgment.

First, the data processing and controlling section 6 waits until a bullet hits the screen 4 (S1, S2). When the bullet hits the screen 4, the data processing and controlling section 6 inputs the coordinates of the impact position calculated by the impact coordinate measuring section 5 (S3). Thereafter, the data processing and controlling section 6 calculates an address of the memory unit 7 where hit/miss data and a score are stored for a divided area, corresponding to the impact coordinates in the training image which was projected when the bullet hit the screen 4 (S4). In this embodiment, each frame of the training image (about 30 frames of image exist in 1 second) is finely divided in the vertical and the horizontal directions to form divided sections. In the memory unit 7, hit/miss data and a score are stored for each of the divided areas. For example, each frame is vertically divided in 480 and horizontally divided in 512.

Then, the data processing and controlling section 6 reads out data from the memory unit 7 based on the calculated address (S5), and performs a hit/miss judgment (S6). When it is judged in step S7 that the trainee hit a target, a hit image is obtained from a certain frame and is played back (S8). On the other hand, when it is judged in step S7 that the trainee missed the target, a miss image is obtained from another frame and is played back (S9). By the above-described processing, the hit/miss judgment is completed for one bullet (S10).

Moreover, the data processing and controlling section 6 measures the length of time from the time when a shooting chance has started and the time when a shooting is actually carried out, and computes a score representing a response time based on the measured length of time. This score is output to the printer 8 together with a hit/miss score.

In principle, data which represent the training image and are stored in the memory medium 16 are related to the data which represent the hit/miss score and are stored in the memory unit 7. Therefore, when a new different training image is prepared, the data of hit/miss score stored in the memory unit 7 are replaced with new data, simultaneously with the replacement of the data in the memory medium 16. With this replacement, target practice using the new training image becomes possible.

Assuming that (1) an image of each frame is divided into 480 dots in the vertical direction and 512 dots in the horizontal direction, that (2) data of a score in each divided section is represented by 8 bits, that (3) data for displaying a hit/miss score for 5 seconds is stored for each training image, and that (4) 15 kinds of training images are used, the amount of data stored in the memory unit 7 approximately becomes 553 megabytes (480 dots×512 dots×8 bits×5 seconds×30 frames×15 kinds/8 bits). Accordingly, the memory unit 7 is formed by a memory unit having a large capacity, such as a magnetic disc-type memory unit or a photomagnetic disc-type memory unit.

When the divisional number of image, the bit number of score data, the time length of the training image or the kinds of the training images increase, a possibility arises that these data cannot be stored in the memory unit 7 even if the memory unit 7 is formed by a magnetic disc-type memory unit or a photomagnetic disc-type memory unit. To overcome this problem, the operation of the data processing and controlling unit 6 may be modified such that the hit/miss judgment is performed only within the period of a shooting chance, and the hit/miss judgment is not performed when the impact of a bullet is detected outside the period of the shooting chance. In a latter case, an impact mark and a message indicating that the shooting was performed outside the shooting chance are composited with the training image by the superimpose compositing unit 2 for display. With this modification, the amount of data to be stored can be reduced.

The amount of data stored in the memory unit 7 can be further reduced by the following measures. In the first measure, the hit/miss data stored in the memory unit 7 are not used for a single frame only, but commonly used for two or more frames. For example, assuming that hit/miss data are set for every two frames, the total time length of these two frames approximately becomes 66.7 mS ((1 second/30 frames)×2), because 30 frames of image exist in one second. When the amount of movement of a person in the training image is within the size of a single divided section, the same scoring results can be obtained as in the case where data are set for every frame.

The second measure is to reduce the amount of data by restricting the movement of a person in the training image within a certain region.

Figure 5:
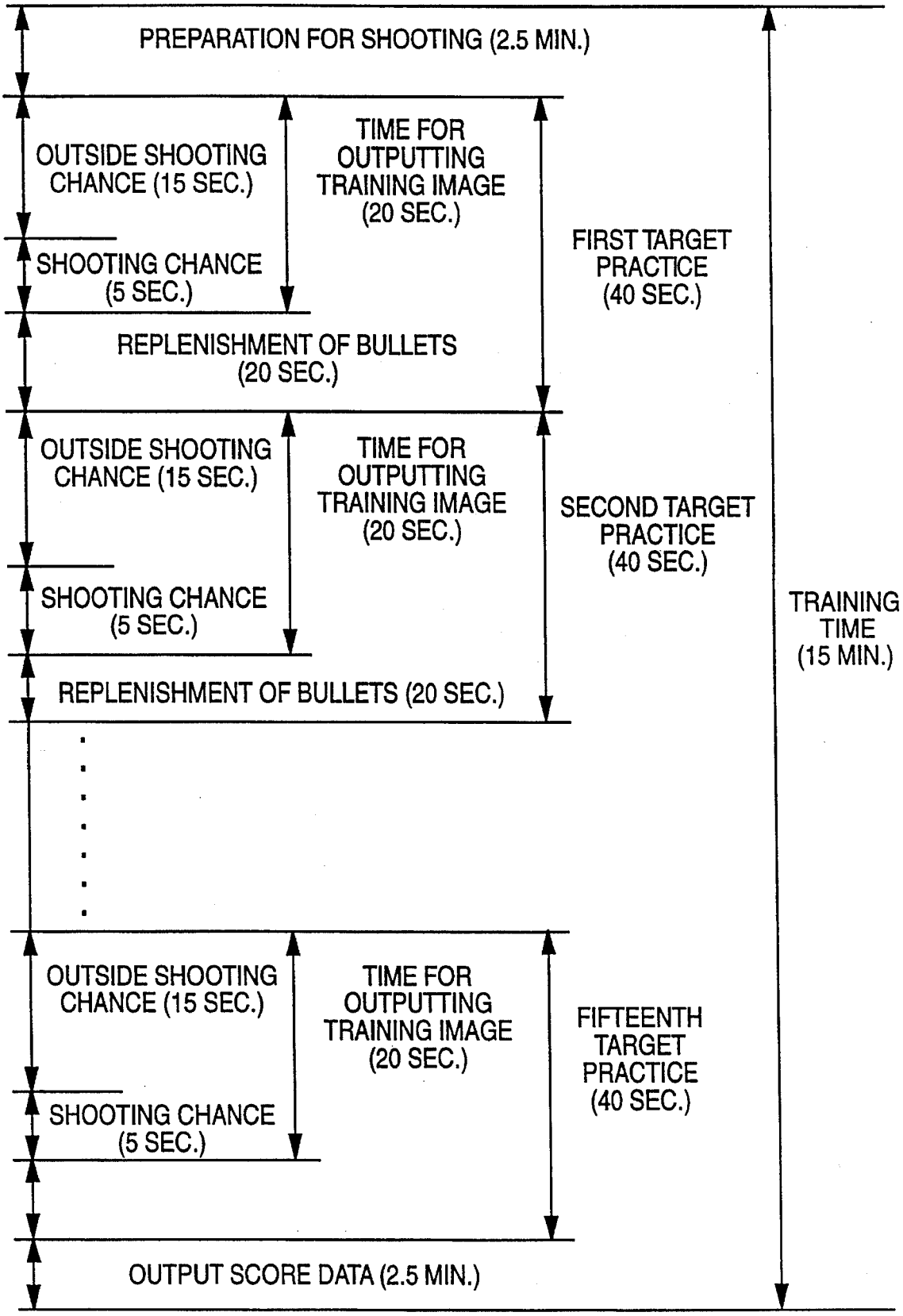
FIG. 5 is an explanatory chart showing the contents of a training image used in the first embodiment.

Next, process for performing switching between the hit image and the miss image, which is shown in FIG. 4, will be described in further detail. FIG. 5 is an explanatory chart showing the contents of a training image, and FIG. 6 is an explanatory chart showing the start frame number and the like of each image of the training image.

The contents of the image in FIG. 5 show contents of training for each shooter. 15 kinds of training images are prepared for one round of training. FIG. 6 shows the start frame number, the end frame number and the like of each training image which is stored in the recording medium 16 and is played back by the playback unit 1. The information of the start frame number, the end frame number and the like is stored in the memory unit 7.

When a first target practice is started, the playback unit 1 plays back an image in "START FRAME NO. (m011) OF IMAGE FOR OUTSIDE OF SHOOTING CHANCE OF 1ST TARGET PRACTICE AND FOR MISS", shown in FIG. 6. This image is projected on the screen 4. The reason why the "image for outside of a shooting chance" and the "image for the case where a bullet missed a target during a shooting chance" are treated as a continuous image is to obtain a continuous smooth image even in the transition period from the outside to the inside of a shooting chance. This continuous image can be obtained by preparing a training image without cutting.

When the frame number of the image currently played back reaches or becomes greater than the frame number of "START FRAME NO. (m012) OF IMAGE FOR SHOOTING CHANCE OF 1ST TARGET PRACTICE", the hit/miss judgment is carried out based on the detection of the impact of a bullet.

If the impact of a bullet is detected during the shooting chance and the bullet hit a target, a playback operation is performed from "START FRAME NO. (m015) OF IMAGE FOR HIT IN 1ST TARGET PRACTICE" to "END FRAME NO. (m016) OF IMAGE FOR HIT IN 1ST TARGET PRACTICE".

When the impact of a bullet is not detected within the shooting chance or when the impact of a bullet is detected but the bullet missed the target, the playback of the training image is continued to "END FRAME NO. (m013) OF IMAGE FOR SHOOTING CHANCE OF 1ST TARGET PRACTICE".

By playing back the images in the above-described frames, one round of target practice is completed. In FIG. 5, the time period of each shooting chance is set to 5 seconds, while the time period outside each shooting chance is set to 15 seconds. However, when the lengths of these time periods are the same in all the training images, the effect of training decreases as the trainee's skill improves. Accordingly, the lengths of time periods, such as the length of the shooting chance are varied for each training image.

Although the playback of each frame of an image is managed using the frame numbers in the above-described embodiment, the playback of each frame of the image may be managed using time codes.

As described above, and as shown in FIG. 4, the image can be switched in case a bullet hit a target and in case where the bullet missed the target in the present embodiment. Since this switching must be performed within about 1 second, it is preferred that the playback unit 1 use a laser disc having a function of random access in which an image can be played back from an arbitrary frame.

With the above-described structure, the target practice apparatus according to the present embodiment allows a trainee to shoot at a target on a moving image with live bullets. Accordingly, it is possible to improve the trainee's ability to make a proper circumstantial judgment and to allow the trainee to effectively gain experience in actual shooting. Thus, the shooting skill of the trainee can be easily increased in shorter periods.

Figure 7:
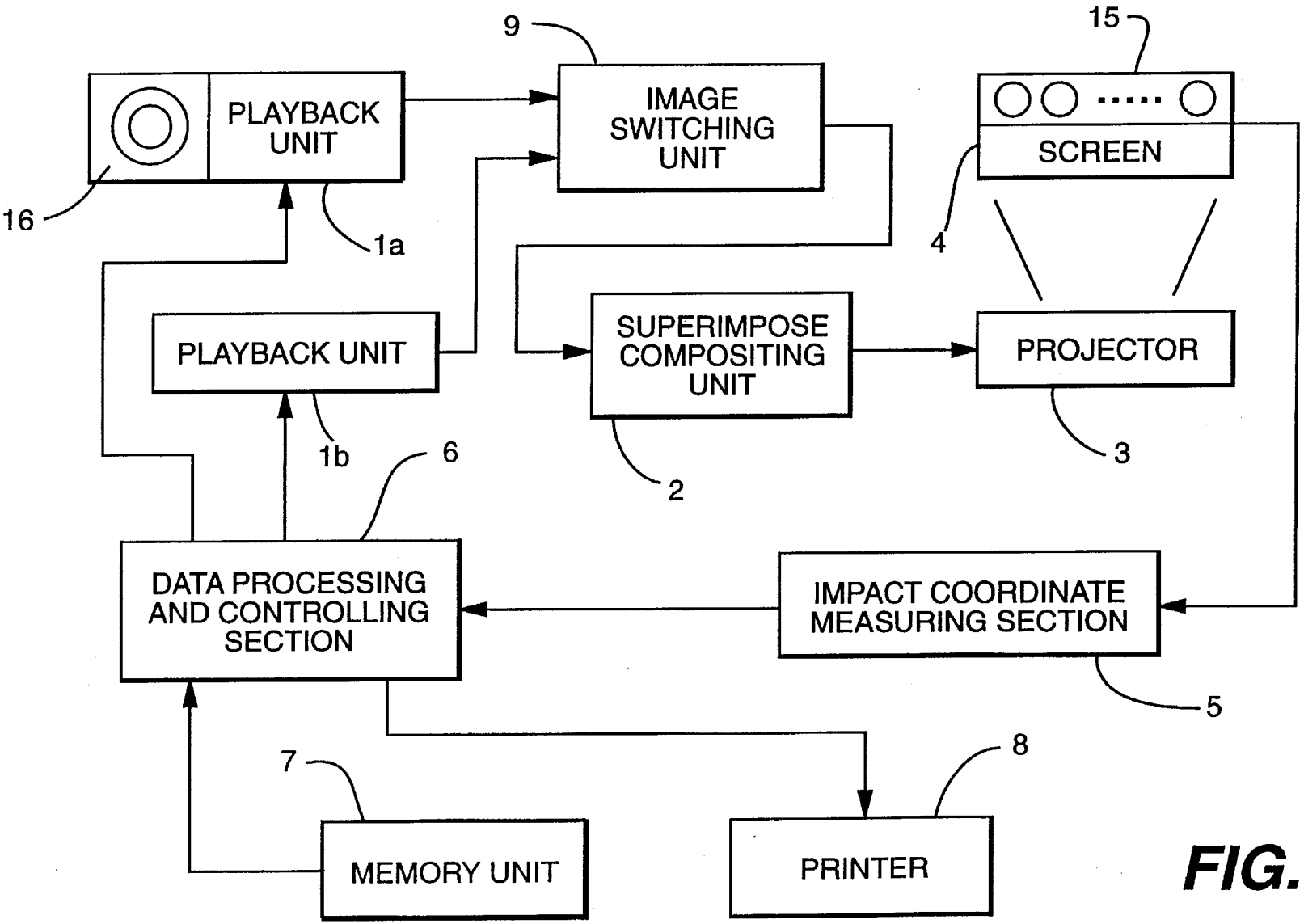
FIG. 7 is a block diagram showing a target practice apparatus according to a second embodiment of the present invention.

FIG. 7 is a block diagram showing a target practice apparatus according to a second embodiment of the present invention. The target practice apparatus of the present embodiment differs from the target practice apparatus of the first embodiment shown in FIG. 1 in that the target practice apparatus according to the present embodiment is provided with two playback units 1*a* and 1*b*, and an image switching unit 9.

The playback unit 1*a* plays back an image in case a bullet missed a target, whereas the playback unit 1*b* plays back an image in case a bullet hit the target. In the playback unit 1*b*, a playback head is initially positioned such that the image for the case where a bullet hit the target is played back upon the start-up.

When a bullet missed the target, the image switching unit 9 outputs an image from the playback unit 1*a* to the superimpose compositing unit 2 as is. On the contrary, when a bullet hit the target, the playback unit 1*b* is started and the image switching unit 9 is operated so that an image from the playback unit 1*b* is output to the superimpose compositing unit 2.

With this structure, the time lag at the time of switching images can be shortened.

Figure 8:
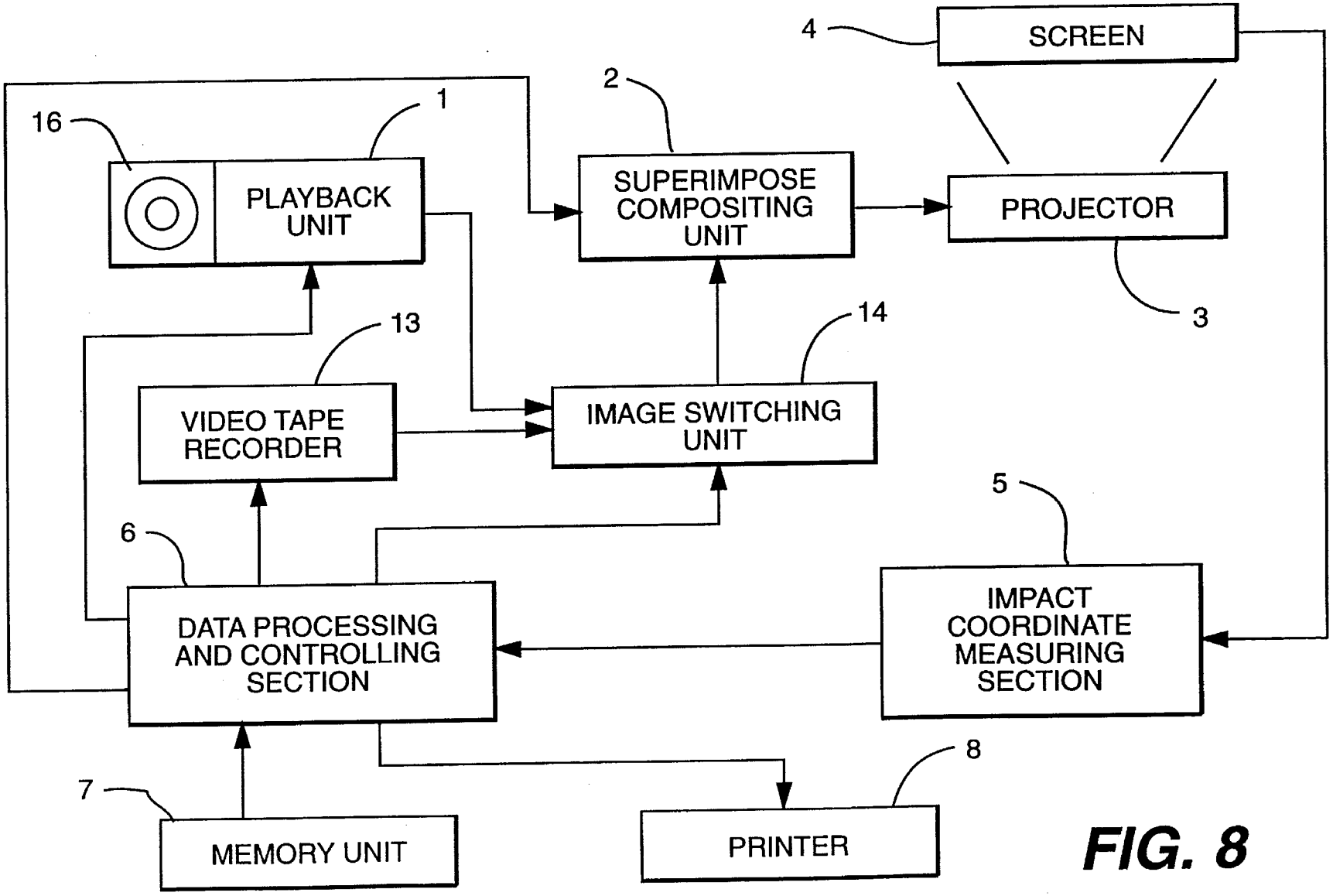
FIG. 8 is a block diagram showing a target practice apparatus according to a third embodiment of the present invention.

FIG. 8 is a block diagram showing a target practice apparatus according to a third embodiment of the present invention. The target practice apparatus of the present embodiment differs from the target practice apparatus of the first embodiment shown in FIG. 1 in that the target practice apparatus according to the present embodiment is provided with a video tape recorder 13 in which a training image is recorded, and an image switching unit 14.

The video tape recorder 13 plays back a predetermined training image which was prepared with a video camera. In the target practice apparatus, when the impact of a bullet is detected, the operation of the video tape recorder 13 is stopped at that time, is brought into its pause state, and is caused to display an impact mark at a position where the bullet impacted. In this embodiment, the training image played back by the video tape recorder 13 is not related to data output from the memory unit which stores hit/miss data. Accordingly, the function of switching images based on the hit/miss judgment is not provided.

The switching between a training image output from the playback unit 1 and a training image output from the video tape recorder 13 is performed by the image switching unit 14 in accordance with the state of a switching switch provided in the data processing and controlling section 6.

With this structure, the target practice apparatus according to the present embodiment can use various training images which were captured by a third person, and easily changes the training image.

Figure 9:
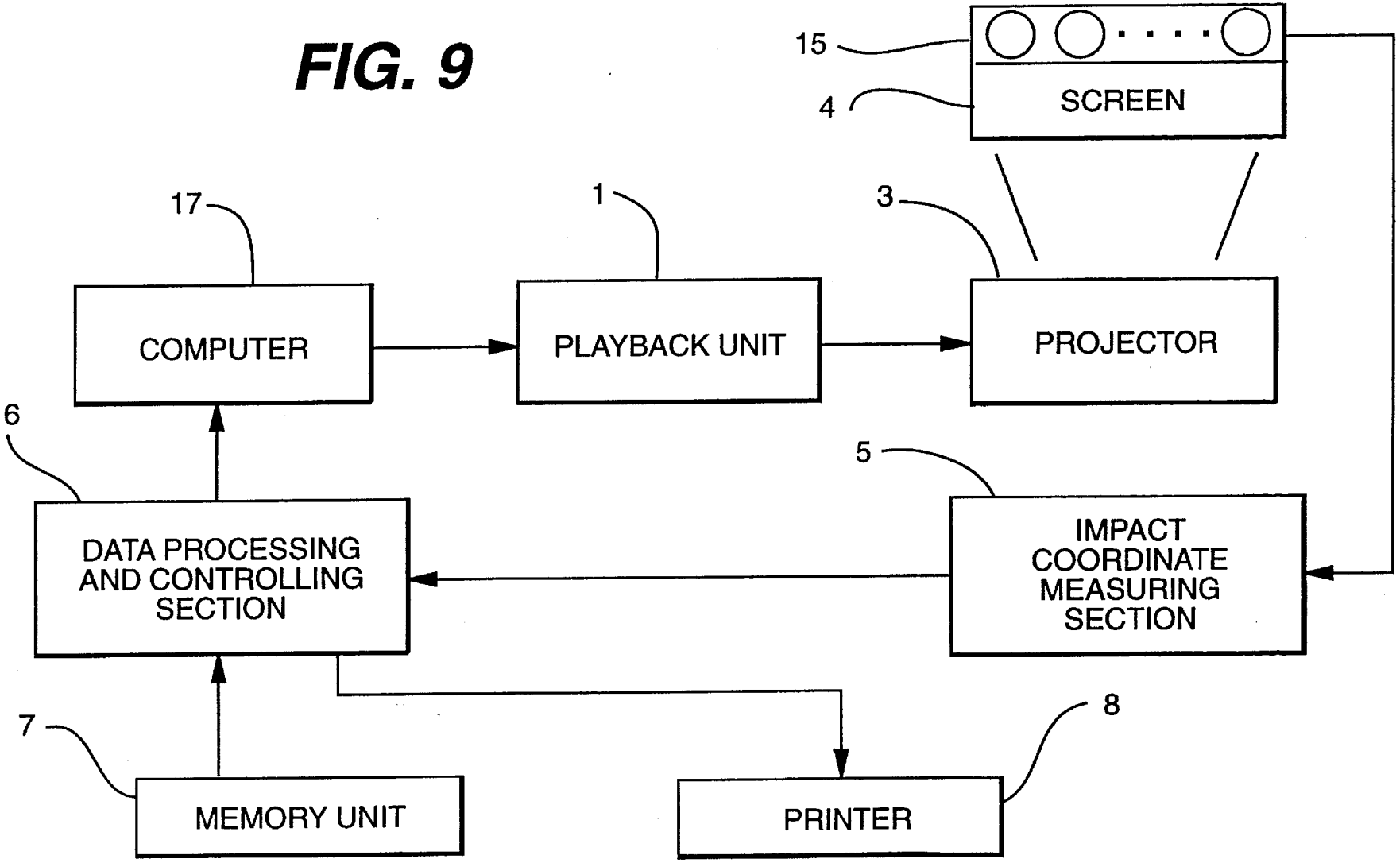
FIG. 9 is a block diagram showing a target practice apparatus according to a fourth embodiment of the present invention.

FIG. 9 is a block diagram showing a target practice apparatus according to a fourth embodiment of the present invention. In the above-described first through third embodiments, images which were actually captured by a video camera or the like are used. By contrast, the target practice apparatus according to the present embodiment uses artificial images which are prepared using computer graphics technology. To this end, the target practice apparatus according to the present embodiment is provided with a computer 17.

With this structure, the target practice apparatus according to the present embodiment can use, as a training image, an image which is difficult or impossible to be captured in a real world.

Figure 10:
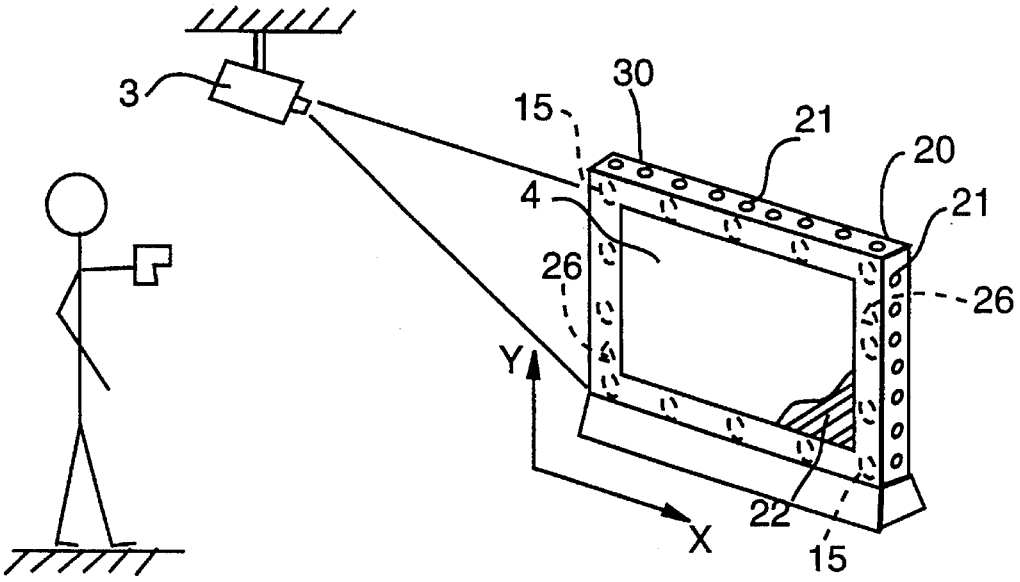
FIG. 10 is a view showing the structure of a target member of a target practice apparatus according to a fifth embodiment of the present invention.

FIG. 10 is a chart showing the structure of a target member of a target practice apparatus according to a fifth embodiment of the present invention.

In this embodiment, a temperature sensor 26 and an acoustic sensor are further provided in the target member shown in FIG. 2. The temperature sensor 26 is used for performing compensation based on sound velocity. The acoustic sensor is provided at a corner of the target member, and a commonly used for detection in the X-axis direction and detection in the Y-axis direction. Especially, the acoustic sensor provided at the corner can eliminate the dead angle in which the impact position of a bullet can not be detected. Also, a time when the acoustic sensor detects the impact of a bullet can be used as a reference time for detection in the X-axis direction and for detection in the Y-axis direction, thereby greatly increasing the accuracy in measuring the impact point.

Figure 11:
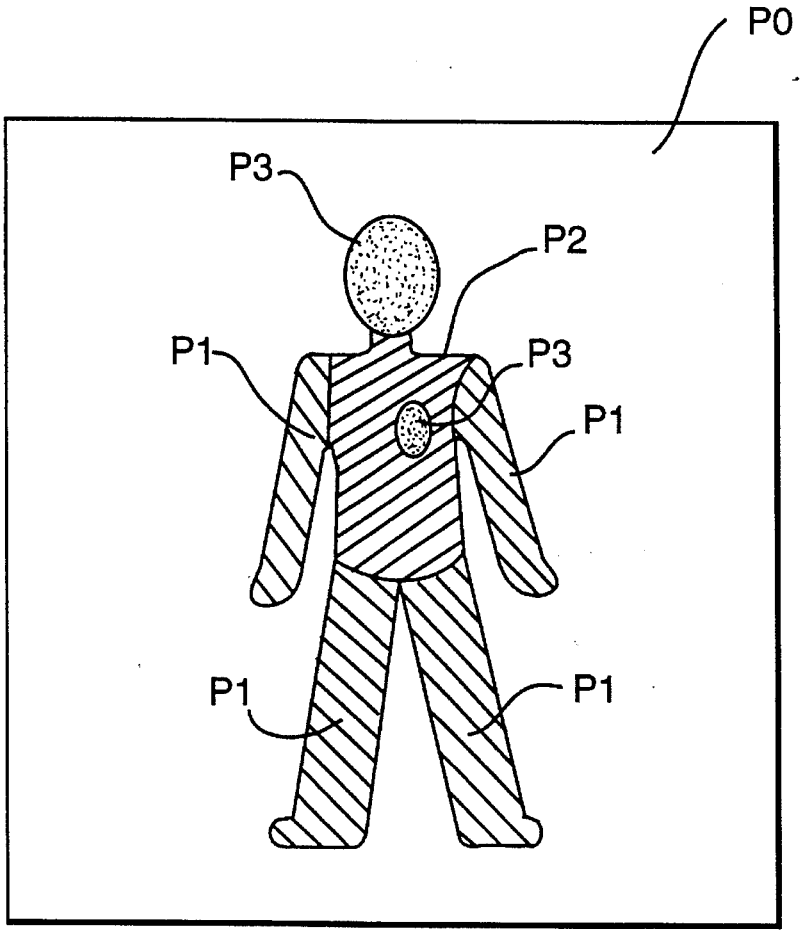
FIG. 11 is an explanatory chart showing data shored in a memory device of a target practice apparatus according to a sixth embodiment of the present invention.

FIG. 11 is an explanatory chart showing data stored in a memory device 7 of a target practice apparatus according to a sixth embodiment of the present invention. A target in a training image is divided into a plurality of areas such as an area PO outside a pattern, areas P1 corresponding to hands and legs, and the like, and different scores are given to these divided areas. Each frame of image stored in the recording medium of the playback unit 7 is subjected to an image processing to obtain a profile line of a pattern of a person. The thus obtained profile line is properly modified to set divided areas and scores therefor. Accordingly, even if various parts of the pattern move in a complex manner, various hit areas can be set. Also, areas can be set in a more detail.

Figure 12:
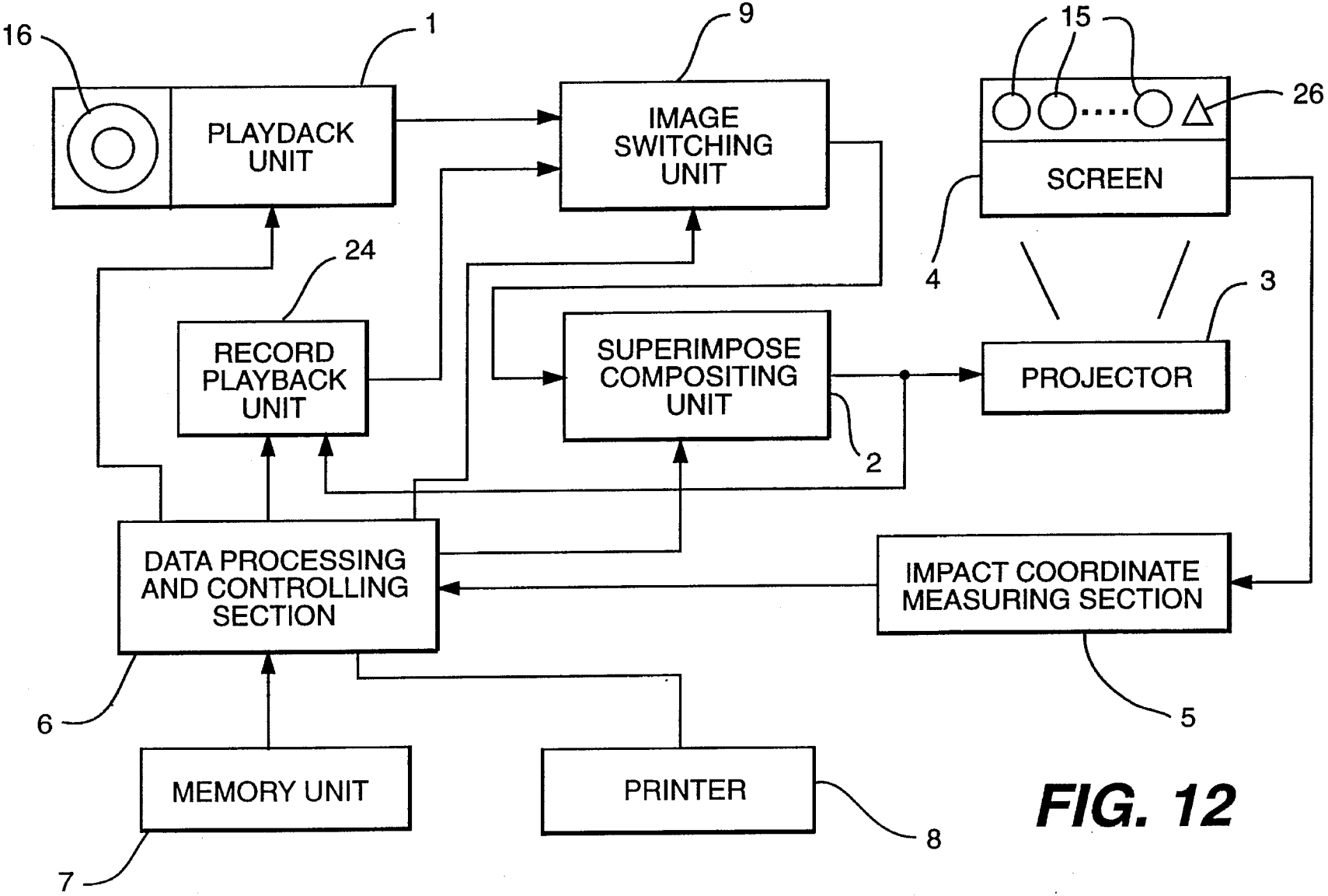
FIG. 12 is a block diagram showing a target practice apparatus according to a seventh embodiment of the present invention.

FIG. 12 is a block diagram showing a target practice apparatus according to a seventh embodiment of the present invention. The target practice apparatus according to the present embodiment differs from the target practice apparatus shown in FIG. 7 in that there is further provided a recording and playback unit 24 which can perform recording and playback of an image. The output signal from the superimpose compositing unit is partially branched and is input to the recording and playback unit 24. With this construction, the recorded training image can be used in a playback mode in which the training image is again passed through the superimpose compositing unit to composite an information message such as a message of a shooting chance with the training image and to output the composited image to the projector.

The output unit 8A is not limited to a printer, and any device, such as a CRT display, which displays or records information can be used.

Obviously, numerous modifications and variations of the present invention are possible in light of the above teachings. It is therefore to be understood that within the scope of the appended claims, the present invention may be practiced otherwise than as specifically described herein.

What is claimed is:

1. A target practice apparatus comprising:

a screen on which a training image is projected;

three or more acoustic sensors for detecting a sound generated when a bullet passes through said screen;

impact coordinate measuring section for computing the coordinates of an impact position on said screen based on differences among points of time when said acoustic sensors detect the sound;

a projector for projecting the training image on said screen;

a playback unit for supplying the projector with an image signal and including a recording medium in which an image representing a hit and an image representing a miss are recorded as well as the training image;

a memory unit in which a hit range and a miss range are previously stored for each frame of said training image;

a data processing and controlling section which controls said playback unit in a frame-by-frame fashion, compares the coordinates of the impact position fed from said impact coordinate measuring section with data of the hit range and the miss range stored in said memory unit so as to perform judgment as to whether a hit or a miss, and selects the image representing a hit or the image representing a miss based on the results of the judgment, and reproduces the selected image;

a superimpose compositing unit for displaying a mark representing an impact position on the screen by superimposing the mark on said training image; and an output device for outputting a list of scores representing the results of the training which are determined based on the results of said judgment.

2. A target practice apparatus according to claim 1, wherein said screen is integrated with said acoustic sensors to form a target member, said target member is provided with a frame for holding the edge of said screen, and a group of at least three acoustic sensors is provided in one side of the frame.

3. A target practice apparatus according to claim 2, wherein said group of acoustic sensors is provided in each of two adjacent sides of said frame which are perpendicularly intersecting each other.

4. A target practice apparatus according to claim 3, further comprising:

an acoustic sensor which is provided at a corner between perpendicularly intersecting two sides of said frame and is commonly used for detection in an X-axis direction and detection in a Y-axis direction; and a temperature sensor used for performing compensation based on sound velocity.

5. A target practice apparatus according to claim 1, wherein said screen is made of rubber and the surface of said screen is white or silver-white.

6. A target practice apparatus according to claim 1, wherein said data processing and controlling section comprises:

time judging means for judging whether it is currently a time in which shooting is allowed or is a time in which shooting is prohibited; and hit judging means for judging whether or not a bullet hits an area within the hit range during the time that shooting is allowed.

7. A target practice apparatus according to claim 1, wherein said playback unit is composed of a first playback unit for playing back a hit image and a second playback unit for playing back a miss image, and an image switching unit is further provided so as to selectively use the hit and miss images.

8. A target practice apparatus according to claim 1, further comprising:

a video tape recorder for recording and playing back an image of results of a target practice; and an image switching unit for selecting the image from said video tape recorder and the image from said playback unit.

9. A target practice apparatus according to claim 1, wherein a recording and playback unit is further provided in parallel to said playback unit, and the output signal from said superimpose compositing unit is branched to be input to said recording and playback unit, and an image switching unit is provided to selectively use the output signal from said recording and playback unit and the output signal from said playback unit.

10. A target practice apparatus according to claim 1, wherein said target practice apparatus further comprises a computer which generates a computer graphic image and which inputs a hit signal or a miss signal output from said data processing and controlling section so as to superimpose an image corresponding to the input signal on the computer graphic image and to output an image signal representing the superimposed computer graphic image to said playback unit, said playback unit reproducing a graphic image from the image signal output from said computer, and said projector projecting the image, which has been reproduced by said playback unit, on the screen using a liquid crystal display projector.

* * * * *